US006592363B2

(12) United States Patent
Hoffmann

(10) Patent No.: US 6,592,363 B2
(45) Date of Patent: Jul. 15, 2003

(54) CHAFING DISH FUEL CANISTER

(76) Inventor: Ross W. Hoffmann, P.O. Box 339, Shelbyville, KY (US) 40066-0339

( * ) Notice: Subject to any disclaimer, the term of this patent is extended or adjusted under 35 U.S.C. 154(b) by 3 days.

(21) Appl. No.: 09/939,494

(22) Filed: Aug. 24, 2001

(65) Prior Publication Data

US 2003/0039936 A1 Feb. 27, 2003

(51) Int. Cl.[7] ..... F23D 3/02
(52) U.S. Cl. ..... 431/320; 126/45; 220/662
(58) Field of Search ..... 431/301, 320, 431/344; 126/43, 45; 220/602, 662, 669; 215/365, 382; 368/93, 327

(56) References Cited

U.S. PATENT DOCUMENTS

| | | | | | |
|---|---|---|---|---|---|
| 201,864 | A | * | 4/1878 | Behn, Sr. | 368/93 |
| 279,915 | A | | 6/1883 | Clark | |
| 756,322 | A | | 4/1904 | Boersig | |
| 991,322 | A | | 5/1911 | Kimball | |
| 1,331,372 | A | * | 2/1920 | Popper | 220/669 |
| 1,367,921 | A | | 2/1921 | Pomije | |
| 2,023,402 | A | | 12/1935 | Brown | |
| 2,469,507 | A | | 5/1949 | Kolter, Sr. et al. | |
| D196,275 | S | | 9/1963 | Neal et al. | |
| 3,490,290 | A | | 1/1970 | Bilson | |
| 3,781,164 | A | | 12/1973 | McCaffery | |
| 4,526,530 | A | * | 7/1985 | Menter et al. | 431/34 |
| 4,624,633 | A | | 11/1986 | Bandel | |
| 4,689,727 | A | | 8/1987 | Perkins | |
| 4,728,286 | A | | 3/1988 | Olsen | |
| 5,000,678 | A | | 3/1991 | Thompson | |
| 5,108,016 | A | | 4/1992 | Waring | |
| D328,492 | S | | 8/1992 | Mathis | |
| 5,447,430 | A | | 9/1995 | Kim et al. | |
| 5,669,767 | A | | 9/1997 | Bureau et al. | |
| 5,690,484 | A | | 11/1997 | Leonard et al. | |
| 5,797,739 | A | * | 8/1998 | Lioi | 431/320 |
| 5,840,257 | A | | 11/1998 | Bureau et al. | |
| 5,904,476 | A | | 5/1999 | Hoffman | |
| D412,448 | S | | 8/1999 | Bentson | |
| 5,980,241 | A | | 11/1999 | Schirneker | |
| D431,478 | S | | 10/2000 | Fortier | |
| 6,217,314 | B1 | * | 4/2001 | Kiesinger et al. | 431/320 |

FOREIGN PATENT DOCUMENTS

| | | | | |
|---|---|---|---|---|
| JP | 11-316021 A | * | 11/1999 | 126/45 |

* cited by examiner

*Primary Examiner*—Henry Bennett
*Assistant Examiner*—James G. Barrow
(74) *Attorney, Agent, or Firm*—John F. Salazar; Charles G. Lamb; Middleton Reutlinger

(57) ABSTRACT

A chafing dish fuel canister is provided with a side wall having a lower section, a middle section and an upper section wherein the lower section and the upper section are substantially vertically extending and the middle section is an angled wall, the middle wall section extending outwardly from the lower wall section at an angle of from about 55 to 85 degrees. This creates a tilt angle such that the flame does not burn the lid or side wall of the fuel canister. The chafing dish fuel canister is preferably of a transparent plastic material and upon being overturned maintains the fuel product therein in a safe condition without spillage.

17 Claims, 3 Drawing Sheets

CHAFING DISH FUEL CANISTER

BACKGROUND OF THE INVENTION

1. Field of the Invention

The present invention relates to food warming devices and in particular to chafing dish fuel canisters which keep the contents in the canister safe should the chafing dish fuel canister be overturned and which inhibits burning of the overturned fuel canister.

2. Discussion of the Prior Art

Chafing dish fuel canisters for maintaining heat to chafing dishes are well known. The chafing dishes are particularly useful for several hours to keep food warm in chafing dishes. However, it is not uncommon for a user of the product to mishandle the canister and inadvertently knock the canister over. And, when these canisters are knocked over there is concern about the fuel in the canister leaking out and setting a fire or the fuel canister flame igniting the canister.

SUMMARY OF THE INVENTION

An object of the present invention is to provide a chafing dish fuel canister which burns combustible fuel in a safe manner.

Another object of the present invention is to provide a chafing dish fuel canister that should the chafing dish fuel canister be overturned the combustible fluid material would be prevented from leaking or spilling out of the canister.

A further object of the present invention is to provide a transparent chafing dish fuel canister thereby allowing the user the opportunity to see how much fuel is left in the canister when in use.

Another object of the present invention is to provide a chafing dish fuel canister which may be made of plastic.

Also an object of the present invention is to provide a chafing dish fuel canister which includes a side wall with a mid portion thereof angled to an upper portion of the side wall and a lower portion of the side wall portion so that if the canister is inadvertently overturned the canister will be lying at an angle therefore preventing spilling of the contents from the container.

Yet an additional object of the present invention is to reduce heat absorption between the flame and the canister lid. If the canister is inadvertently overturned, the angle of the side wall is such that the flame should not burn or overheat the canister lid.

More particularly, the present invention provides a chafing dish fuel canister having an upper annular rim with a canister lid fixed to the upper annular rim. An outer sleeve with an inner sleeve spaced inwardly therefrom extends upwardly from the canister lid through said inner sleeve and said outer sleeve. A chafing dish fuel canister is provided with an open top having an upper annular rim and a closed bottom with a side wall disposed therebetween. A side wall of the container is provided with a lower section, a middle section and an upper section, each of said lower section and said upper section being vertically extending walls and the middle section being an angled wall section, said middle section wall extending outwardly from the lower section at an angle of from about 55 to 85 degrees, and preferably about 70 degrees. The tilt angle, which is the angle between a vertical flame and the canister lid when the canister is on its side, of the fuel canister is such that a flame does not burn the lid of the fuel canister or the side wall when the fuel canister is inadvertently knocked over.

All of the above outlined objectives are to be understood as exemplary only and many more objectives of the invention may be gleaned from the disclosure herein. Therefore, no limiting interpretation of the objectives noted are to be understood without further reading of the entire specification, claims, and drawings included herewith.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
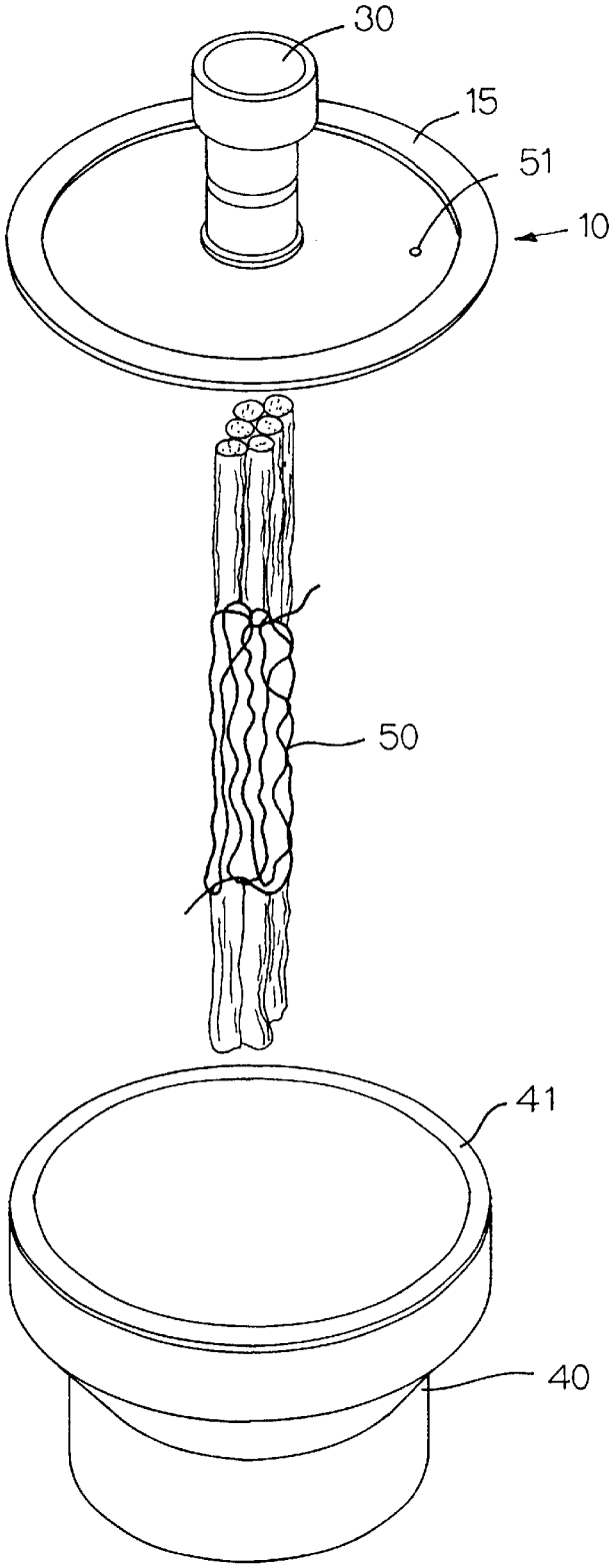
FIG. 1 is an exploded perspective view of the chafing dish fuel container of the present invention.

The chafing dish fuel canister 10 of the present invention as shown in the figures is utilized to heat water in chafing dishes which creates steam thereby warming food held in the chafing dish food pan. Typically, the fuel canister 10 is lit underneath the water pan chafing dish and allowed to burn unattended for long periods of time. As shown in FIG. 1, lid 15 is shown having attached thereon a reservoir sleeve 30. A wick 50 extends upwards from container 40 which holds combustible fluid material 60. Lid 15 is provided for fitting over container rim 41 of container 40 for a tight seal thereby preventing spillage of combustible fluid 60. Wick 50 extends upwards from container 40 through reservoir sleeve 30 and allows lighting and burning of the combustible material.

Figure 2:
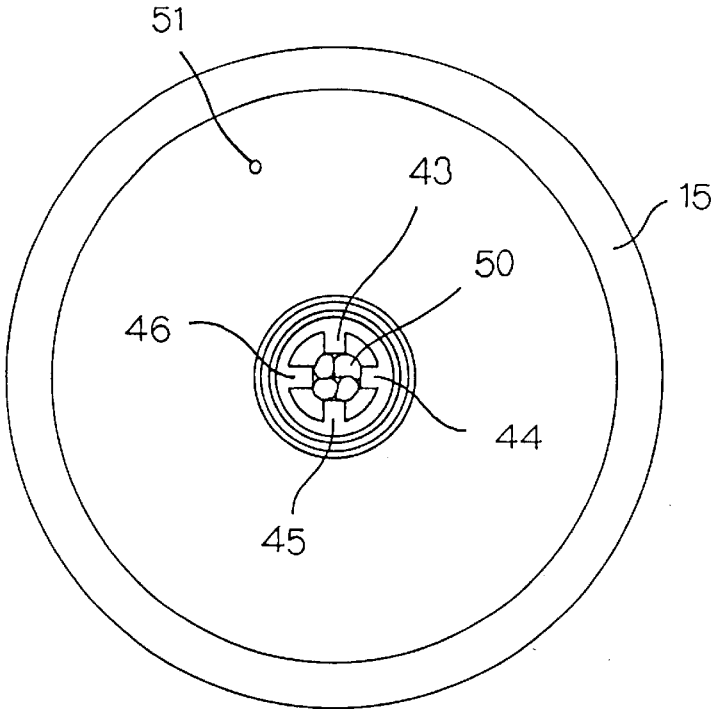
FIG. 2 is a top view of the chafing dish fuel container of the present invention.
Figure 3:
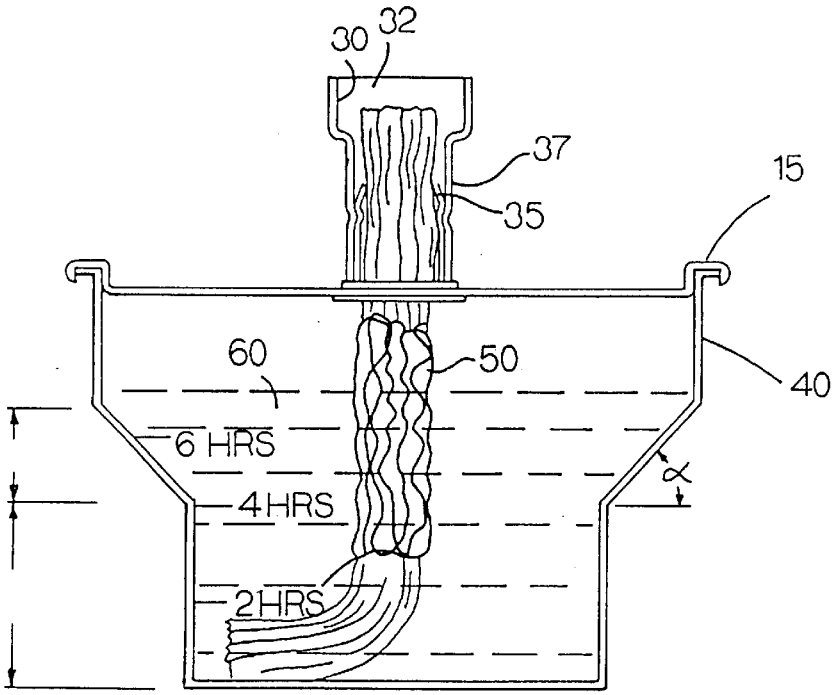
FIG. 3 is a side view of the chafing dish fuel container of the present invention; and, FIG. 4 is a side view of the chafing dish fuel container of the present invention in an overturned condition.

The chafing dish fuel canister 10 may be made of various thermoformable plastics but preferably is formed of transparent polyvinyl chloride (PVC) having burn resistant characteristics. An alternative material may be PET, which has a higher burn temperature than PVC, although PVC has better shape retaining qualities when exposed to high heat. Turning to FIG. 3, a cutaway side view of the chafing dish fuel canister 10 of the present invention is shown. Container 40 holds combustible fluid material 60 which is burned via wick 50. The dual sleeves 30 and 35 through which the wick extends is comprised of two separate sleeve elements. Inner sleeve 35 is press fitted onto the lid 15 and extends upwards therefrom providing an access area through which the wick may extend. At the upper portions of inner sleeve 35 are found wick holding prongs 43, 44, 45 and 46, shown in FIG. 2, which hold the wick in place and prevent the wick from sliding downward back into the container 40. Each of prongs 43, 44, 45 and 46 are directed inwards towards the center of the inner sleeve 35 and are also directed upwards at a slight angle. This prevents wick 50 from falling back down into the container 40 after the lower portion of the wick becomes laden with combustible fluid 60. Wick 50 is usually a fiberglass wick comprised of six smaller strands of fiberglass wrapped in a fiberglass mesh weave. The top end of the wick is bent over and inserted into the inner sleeve 35 and held in place by prongs 43, 44, 45 and 46. When the container 40 is used, the bottom end of the wick reaches far enough down to touch the bottom of the can enabling the capillary action to use all the fuel 60 until the wick is extinguished.

Secured and slid over the top of inner sleeve 35 is placed reservoir sleeve 30. Reservoir sleeve 30 is crimped over inner sleeve 35 causing crimp indentation 34. After crimping, reservoir sleeve 30 cannot be removed from overlaid attachment to inner sleeve 35. Reservoir sleeve 30 has a wider reservoir 32 formed at the upper portion and a narrower neck portion 37 just below the reservoir 32.

Reservoir sleeve 30 additionally has reservoir 32 formed at the upper portion thereof through which wick 50 extends and is defined by circular side walls of the reservoir sleeve 30. The upper portion of reservoir sleeve 30 defines the widest area of the reservoir 32 within which the wick 50 burns. During the burning of the combustible material 60, capillary action of the wick and burning fluid causes excess combustible fluid which is not burned to pool around the upper exposed portion of wick 50. Reservoir 32, formed by the increase in diameter of reservoir sleeve 30 as compared to reservoir neck portion 37, provides an area for said excess combustible material to pool instead of allowing the fluid to drip down the side of the wick sleeve.

The chafing fuel canister 10 is provided with a downwardly extending side wall 41 which is in three sections, a lower cylindrical section 49, a middle cylindrical section 48 and an upper cylindrical section 47. The lower section 49 and the upper section 47 are provided with vertically extending walls wherein the outer diameter of the upper section 47 is greater than the lower section 49. The middle section 48 is at an angle "α" to the lower section and this angle will be from about 55 to 85 degrees, preferably about 70 degrees. This configuration causes the fuel canister 10 to have a tilt angle which is defined as the angle between a vertical flame and the lid 15 when the fuel canister 10 is resting on its side. The tilt angle may range from about 1 to 90 degrees, but preferably is about 7 degrees. The tilt angle inhibits a flame from burning the lid 15 or fuel canister 10 if the fuel canister 10 is knocked over because a vertical plane extending from a wick 50 will not intersect a plane defined by the lid 15. Therefore, a fuel canister of the present invention will exhibit significant burn inhibition of the lid 15 and side wall 41 when a flame is emitted from the wick 50 and the canister 10 is on its side.

Figure 4:
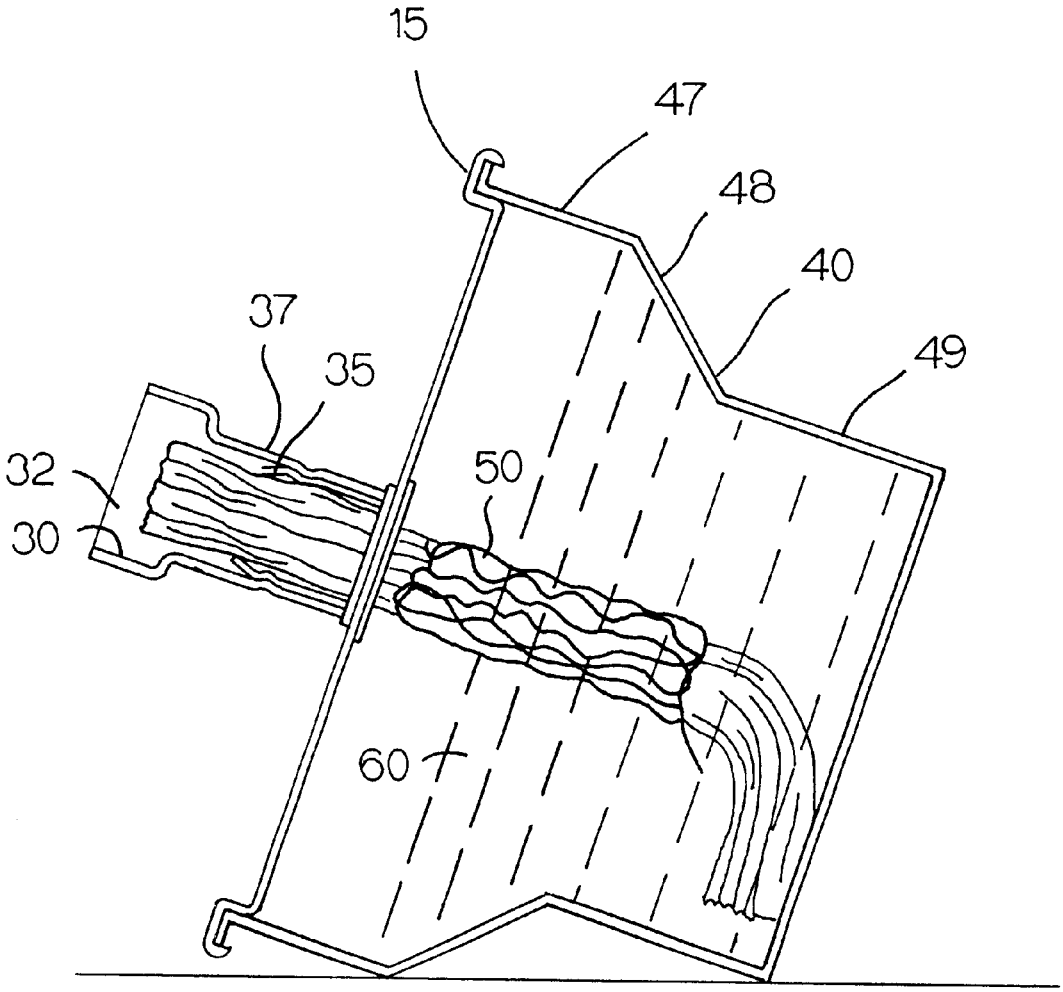

In a preferred embodiment the lower section 49 has a vertical length of about ⅞", the middle section 48 has a vertical length of about ⅞", and the upper section 47 has a vertical length of about ¾". However, one skilled in the art will recognize that any combination of dimensions may be used such that when the fuel canister 10 is overturned, the angular displacement between a vertical flame and the lid 15 or side wall 41 of the fuel canister inhibits or prevents burning of the lid 15 or side wall 41. As shown in FIG. 4 when the canister 10 is overturned the liquid fuel 60 therein will not spill out and will be contained within the container away from the flame. Moreover, the angled side wall 41 prevents the container 40, which is preferably a transparent plastic container, from melting due to the heat from the flame when in the overturned condition.

As shown in FIG. 4 the canister 10 includes graduation lines or indicia on the side wall 41 so that in an upright condition the consumer will be able to determine the amount of fuel left in the canister 10 due to the transparent or translucent nature of the material of which the canister 10 is made. This can include polyvinyl chloride ("PVC") having burn resistant characteristics, PET which has a higher burn temperature than PVC, or any other transparent heat formable plastic having good burn resistant characteristics. As shown in FIG. 2, venting hole 51 is provided to allow for proper venting of canister 40 and pressure equalization after lid 15 is secured thereon. As the fuel burns at wick 50, the level of combustible fluid within canister 40 lowers accordingly. In order to allow for proper pressure release within the canister as the level of fluid slowly lowers, venting hole 51 provides an access point for air to enter into the canister. Prior to use of the chafing fuel dish 10, tape or other removable cover is placed over the venting hole 15 to prevent fluid 60 from spilling out of the canister. Prior to use, the tape is removed to properly vent the canister 40 during burning of the fluid 60.

In use, the chafing fuel canister 10 is filled with appropriate combustible material, typically diethylene glycol ("DEG") which burns for approximately 6 hours. During burning of the combustible fluid 60, a flame burns within reservoir 32, ignited by fuel 60 drawn upwards along wick 50. After long periods of use, excess fluid which is drawn upwards by capillary action from the container 40 may not be burned. This excess fluid, instead of running down the side of the wick sleeve as in prior art devices, collects within reservoir 32 bounded by reservoir sleeve walls 30 and allows the fluid to either be burned off by the flame emitted from the wick 50 or drain back downward into the canister through interior sleeve 35.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A chafing dish fuel canister, comprising:

a canister having an upper annular rim surrounding an open top and a closed bottom with a side wall disposed therebetween;

a canister lid securely affixed to said upper annular rim of said canister;

at least one sleeve extending upward from said canister lid and receiving a wick therein, said wick extending into said canister; and, said canister side wall having a lower section, a middle section and an upper section, each of said lower section and said upper section being vertically extending walls and said middle section being an angled wall, said middle section extending outwardly from said lower section at an angle of from about 55 to 85 degrees.

2. The canister of claim 1, said canister being transparent.

3. The canister of claim 2, said canister being plastic.

4. The canister of claim 3, including graduation indicia along said side wall.

5. The canister of claim 4, wherein said middle section extends outwardly from said lower section preferably at an angle of about 70 degrees.

6. The canister of claim 4, said lower section having a vertical length of about ⅞", said middle section having a vertical length of about ⅞", and said upper section having a vertical length of about ¾".

7. The canister of claim 6, said sleeve including an inner sleeve spaced from an outer sleeve, said outer sleeve extending upwardly beyond said inner sleeve, said inner sleeve including indentations to hold said wick in an upright condition.

8. A chafing dish fuel canister, comprising:

a canister having an upper annular rim rounding an open top and a closed bottom with a side wall disposed therebetween;

a canister lid securely affixed to said upper annular rim of said canister;

at least one sleeve extending upward from said canister lid and receiving a wick therein, said wick extending into said canister;

said canister side wall having a lower section, a middle section and an upper section, each of said lower section and said upper section being vertically extending wall and said middle section being an angled wall, said middle section extending outwardly from said lower section at an angle of from about 55 to 85 degrees; and, wherein said fuel canister is transparent and has graduation indicia along at least one of said upper section, middle section, and lower section.

9. The canister of claim 8, said sleeve including an inner sleeve spaced from an outer sleeve, said outer sleeve extending upwardly beyond said inner sleeve, said inner sleeve including indentations to hold said wick in an upright condition.

10. The canister of claim 8, wherein said fuel canister is made of burn resistant PVC.

11. The canister of claim 10, said lower section having a vertical length of about ⅞", said middle section having a vertical length of about ⅞", and said upper section having a vertical length of about ¾".

12. The canister of claim 10, wherein said middle section extends outwardly from said lower section wall preferably at an angle of about 70 degrees.

13. A chafing dish fuel canister, comprising:

a canister having an upper annular rim rounding an open top and a closed bottom with a side wall disposed therebetween;

a canister lid securely affixed to said upper annular rim of said canister;

at least one sleeve extending upward from said canister lid and receiving a wick therein, said wick extending into said canister;

said canister side wall having a lower section, a middle section and an upper section, each of said lower section and said upper section being substantially vertical and said middle section being angled, said middle section extending outwardly from said lower section to said upper section; and, wherein said fuel canister has a tilt angle such that a vertical plane extending from a wick does not contact a plane defined by said lid when said canister is laying on said sidewall.

14. The chafing dish fuel canister of claim 13, wherein said side wall is transparent and includes graduation indicia along said side wall.

15. The chafing dish fuel canister of claim 13, wherein said tilt angle is between about 1 degree and 90 degrees.

16. The chafing dish fuel canister of claim 15, wherein said tilt angle is about 7°.

17. A chafing dish fuel canister, comprising:

a canister having an upper annular rim rounding an open top and a closed bottom with a side wall, a lid affixed to said upper annular rim of said canister, at least one sleeve extending upward from said canister lid and receiving a wick therein, said wick extending into said canister, said canister side wall having a lower section, a middle section and an upper section, each of said lower section and said upper section being substantially vertical and said middle section being angled, said middle section extending outwardly from said lower section to said upper section, wherein said canister has a tilt angle created by a vertical plate extending from said wick to said lid when said canister is laying on said side wall, said tilt angle being about 7 degrees to about 15 degrees.

* * * * *